United States Patent [19]

Stofle et al.

[11] Patent Number: 4,911,335

[45] Date of Patent: Mar. 27, 1990

[54] PNEUMATIC ACTUATED SWITCH FOR HOT WATER DISPENSER

[75] Inventors: Kenneth F. Stofle, Whittier; Robert Milich, Long Beach; Richard Shields, Huntington Beach; William L. Blowers, Newhall; Walter Kovacs, Downey, all of Calif.

[73] Assignee: White Consolidated Industries, Inc., Cleveland, Ohio

[21] Appl. No.: 210,383

[22] Filed: Jun. 23, 1988

Related U.S. Application Data

[63] Continuation-in-part of Ser. No. 115,900, Nov. 2, 1987, abandoned.

[51] Int. Cl.[4] ..... B67D 5/06

[52] U.S. Cl. ..... 222/192; 222/146.2; 137/216; 251/57

[58] Field of Search ..... 222/52, 144.5, 146.2, 222/192; 4/623; 134/115 R; 137/216, 341, 801; 251/129.04, 57, 129.15

[56] References Cited

U.S. PATENT DOCUMENTS

| | | | |
|---|---|---|---|
| 3,620,241 | 11/1971 | Brown | 137/216 |
| 3,638,680 | 2/1972 | Kopp | 251/57 X |
| 3,967,638 | 7/1976 | Tondreau | 137/216 |
| 4,399,832 | 8/1983 | Appleby | 137/216 |
| 4,454,891 | 6/1984 | Dreibelbis et al. | 137/216 |
| 4,635,673 | 1/1987 | Gerdes | 137/216 |
| 4,771,485 | 9/1988 | Traylor | 137/216 X |

*Primary Examiner*—Joseph J. Rolla
*Assistant Examiner*—Gregory L. Huson
*Attorney, Agent, or Firm*—Alfred E. Miller

[57] ABSTRACT

A combined air gap and dispensing device is adapted to be mounted on a sink, and comprises an internal air gap between inlet and outlet waste tubes. A liquid carrying pipe, such as a hot water pipe, also extends through the device to a faucet for being dispensed. A pair of fiber optic cables have exposed ends at the upper end of the device, and are coupled to a control system for valving liquid to the dispensing pipe. The control circuit may include a light source directed to one of the fiber optic cables, a photo sensor connected to the fiber optic cable to receive reflected light, and amplifying and demodulating circuitry, as well as a logic circuit responsive to determined conditions at the upper ends of the fiber optic cables for controlling the flow of liquid to the dispensing pipe. A pneumatic tube and pneumatic actuator may be provided instead of the optic cables and associated optic devices.

7 Claims, 8 Drawing Sheets

90HZ OSCILLATOR
R/C
OUTPUT
187
183
7.2K
3.6K
10.2K
4.7K
2.4K
30K
3.6K
2.4K
10K
LED POWER DRIVER
186
184
LED
185
12 VOLT REGULATOR
182
60K
3.6K
8.2K
161
+UNREG.
180
181
GND.
DEMODULATOR
DEMOD. OUTPUT
196
195
AC SIGNAL AMPLIFIER
191
SCHMITT TRIGGER
198
INPUT
197
OUT
20K
10K
12.4K
100
30K
3.6K
7.2K
7.2K
10K
3.6K
3.6K
10K
10K
200
30K
20K
30K
200
COMPENSATION
192
INPUT
190
TRIAC DRIVE
200
TRIAC DRIVER
4.3K
10K
1/2 IN
201
1/2 OUT
202
1 OR 2 TOUCH
SEQUENCE LOGIC CIRCUITRY
199
3.6K
7.2K
7.2K
7.2K
7.2K
3.6K
3.6K
3.6K
3.6K
3.6K
3.6K
3.6K

PNEUMATIC ACTUATED SWITCH FOR HOT WATER DISPENSER

This application is a continuation-in-part of application Ser. No. 115,900 filed Nov. 2, 1987 and now abandoned.

This invention relates to a liquid dispensing device, and is more in particular directed to the combination of an air gap and liquid dispenser especially adapted for use on a sink. While the dispensing device is especially adapted for the dispensing of hot water, it is apparent that the invention also may be advantageously employed in the dispensing of other liquids.

It is frequently desirable to provide a liquid dispenser such an instant hot water dispenser, on a sink. Conventionally, installation of such a dispenser requires the drilling of a hole in the sink. This requirement has in the past limited the installation of such dispensers, the drilling of porcelain or stainless steel sinks generally not being within the capability non-expert personnel. In addition, prior installation techniques required conventional plumbing tools, tools which are not universally available to persons whose profession is not plumbing.

The present invention is therefore directed to the provision of a liquid dispenser that may be simply and readily attached to a sink or the like by non-expert personnel.

It is well-known that various appliances having water outlet connections, are required to provide air gaps between the outlet lines and a drain system in order to avoid reverse flow of waste water. Such air gaps are frequently provided, for example, for a dishwasher, in the form of an air gap mounted in a hole in the sink.

Briefly stated, in accordance with the invention, a liquid dispensing device is combined with an air gap, whereby the device may be installed in a hole already provided in the sink, to serve both of these functions. Since the hole is already provided in the sink, installation of the device is simplified. The invention is especially adapted to an arrangement of such a dispensing device that further simplifies installation thereof, for example by not requiring the use of wrenches under the sink to firmly fasten the device to the sink.

In accordance with the invention, the device is mounted in a hole in the sink that may have been previously employed for an air gap fixture, and the device can be affixed to the sink by a nut under the sink. A cooperating cam arrangement above the sink, operated by rotation of a sleeve around the column, enables the manual exertion of axial pressure on the column to clamp the column to the sink.

The device has waste inlet and outlet tubes extending through the column, to an air gap defined above the sink. A removable air gap cover is mounted over the waste tubes, to deflect liquids from the inlet to the outlet, in the air gap. A hot water or other liquid tube also extends sealingly through the column, to a laterally extending faucet.

In order to control the liquid dispensed through the faucet, a pair of fiber optic cables also extend sealingly through the column, and terminate exposed and flush at the upper end of the dispenser. An electrical control circuit applies a light to one of the cables, and includes a photosensor at the lower end of the other cable for receiving reflected light. The electrical circuit is responsive to selected conditions of reflected light for controlling a solenoid valve, to pass heated water through the liquid dispensing tube. As a consequence, for example, heated water may be dispensed upon the placing of a finger a determined number of times at the top of the dispenser. Such selective operation inhibits accidental dispensing of hot water, or operation of the device by a child.

In a modification of the invention, a pneumatic control system may be substituted for the optic control system.

In order that the invention may be more clearly understood, it will now be disclosed in greater detail with reference to the accompanying drawings, wherein.

Figure 1:
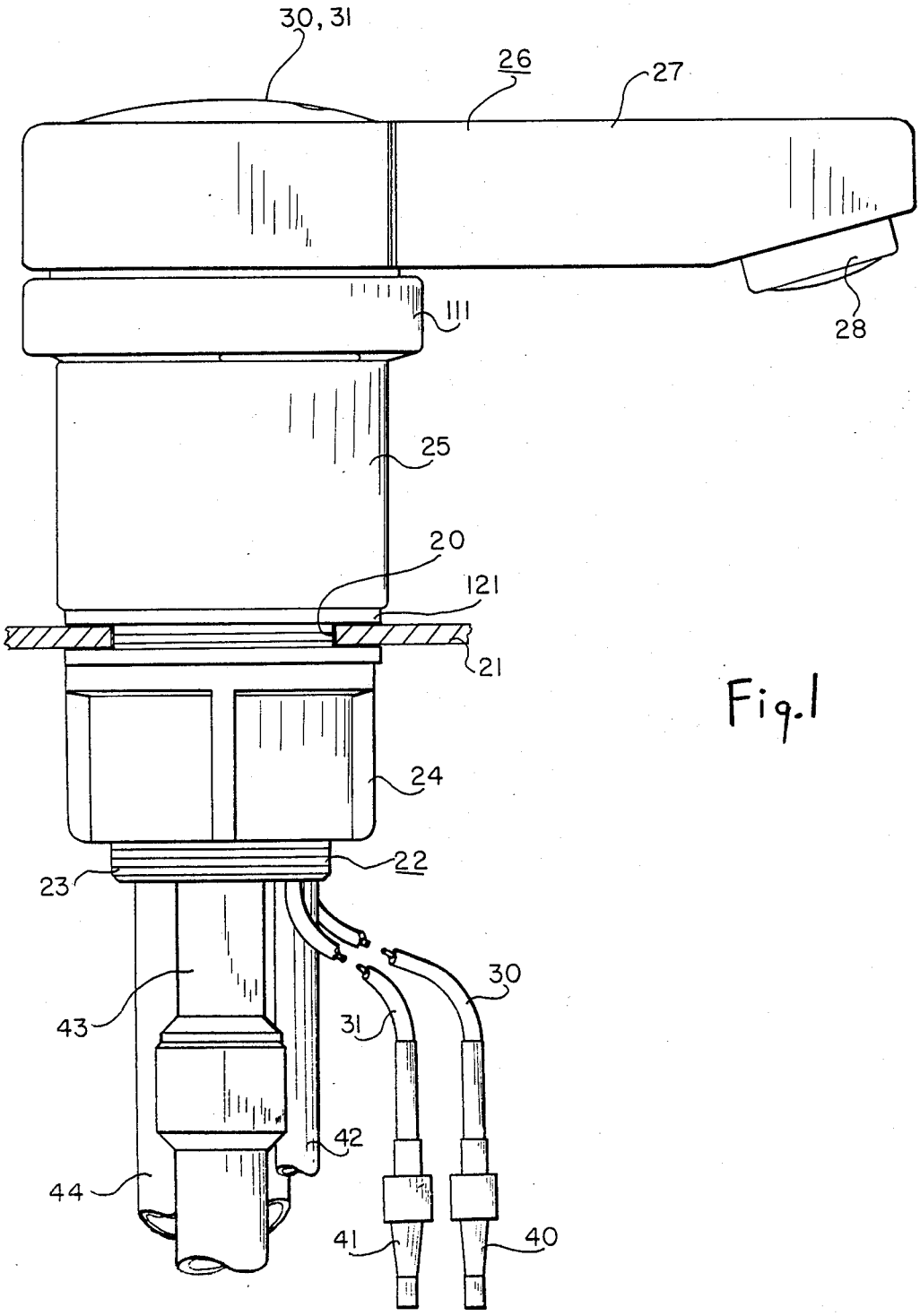
FIG. 1 is a side view of a dispenser in accordance with one embodiment of the invention.
Figure 2:
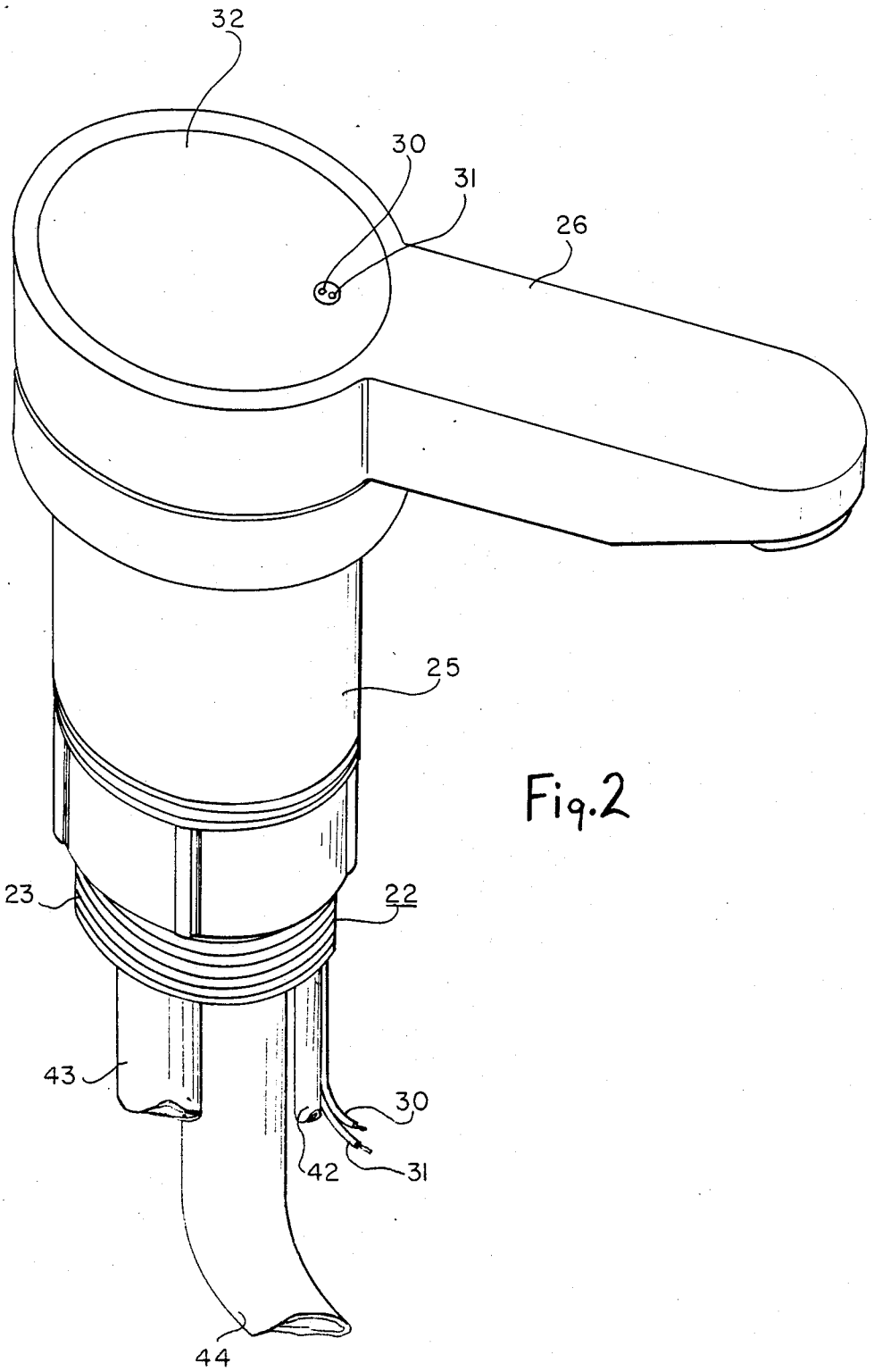
FIG. 2 is a perspective view of the dispenser of FIG. 1.

Referring now to FIGS. 1 and 2, therein is illustrated a preferred embodiment of a hot water dispenser in accordance with the invention. The hot water dispenser is adapted to be mounted in a hole 20 in a sink 21 or other panel in close proximity to a sink. The appliance is comprised of a central hollow column 22, only the lower end of which appears in the illustrations of FIG. 1 and 2, this lower end 23 being threaded for receiving a nut 24 at the lower end thereof, the nut being engagable with the underside of the sink 21. The upper visible portion of the appliance includes a sleeve 25 extending from the top of the sink 21 to the faucet extension 26. The faucet extension 26 has a portion 27 extending laterally from the appliance, and having a generally downwardly directed nozzle 28. The extension 27 is preferably rigidly affixed to the column 22, i.e. it is not pivotable with respect to the sink after the appliance has been fully installed. The upper ends of a pair of fiber optic cables 30, 31 extend substantially to the surface of a central cover 32 of the faucet extension 36, the central cover 32 being generally coaxial with the column. As will be discussed in the following paragraphs, the exposed ends of the fiber optic cables cooperate with a control circuit to enable dispensing hot water or other suitable liquid from the faucet in response to the holding of a finger or object in the proximity of the fiber optic cable ends.

As further illustrated in FIGS. 1 and 2, the lower ends of the fiber optic cables 30, 31 extend through the column 32 and downwardly therefrom, to terminate in fiber optic cable connectors 40, 41 for connection to a sensing circuit as will be disclosed. Further, a tube 42 extends downwardly and out the bottom of the column 22, and adapted to be connected to a hot water supply or other liquid supply for dispensing through the nozzle 28.

As will be further discussed, the internal components of the appliance include an air gap, for example for a dishwasher or other appliance, and the appliance of the invention accordingly has a tube 43 extending downwardly through the column 22 for connection to the waste outlet of the dishwasher or other appliance, as will as an outlet tube 44 for liquids after they have passed through the air gap, the tube 44 hence being adapted to be connected to a waste water system.

Figure 3:
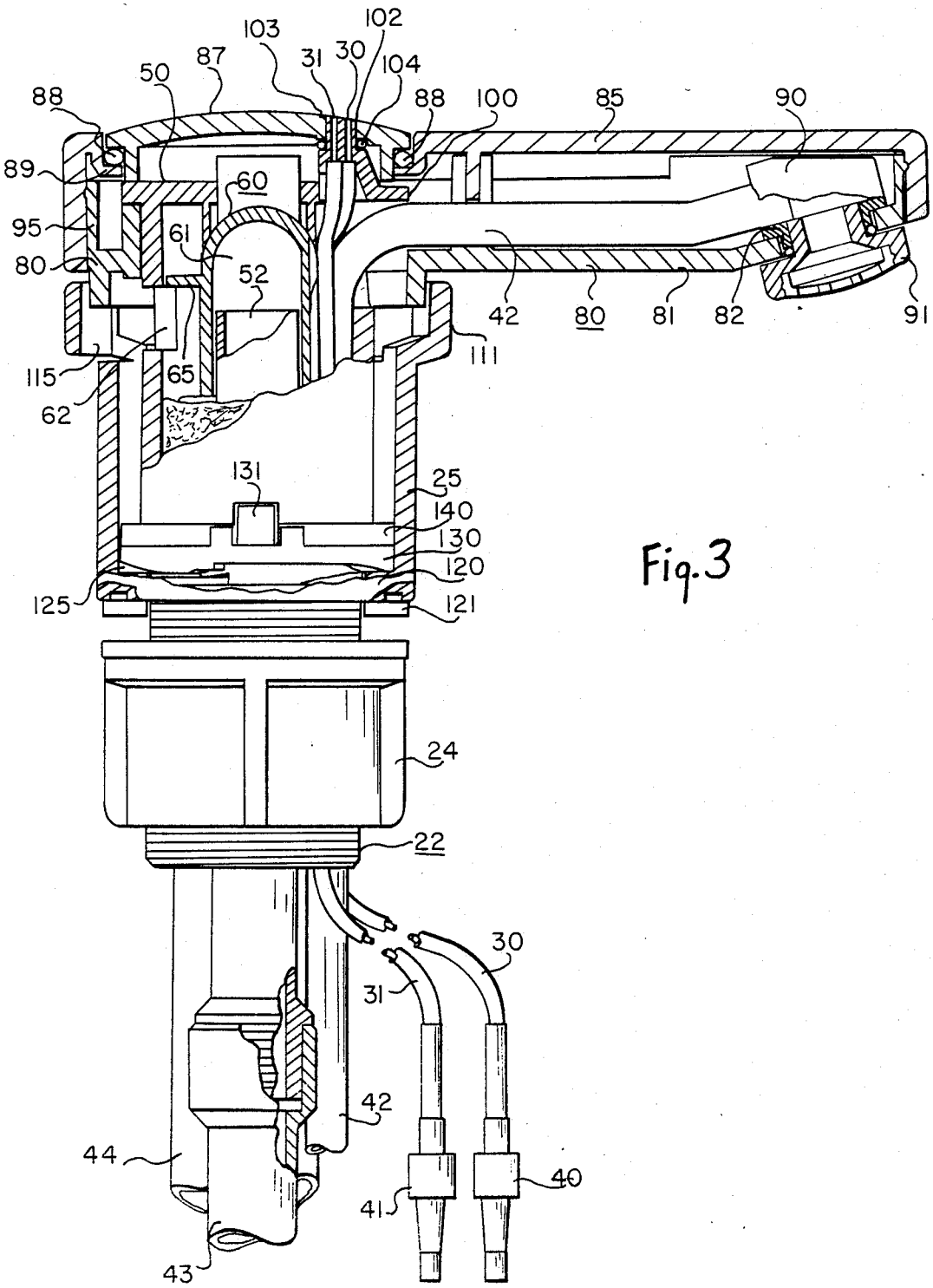
FIG. 3 is a partial longitudinal cross section of the dispenser.
Figure 7:
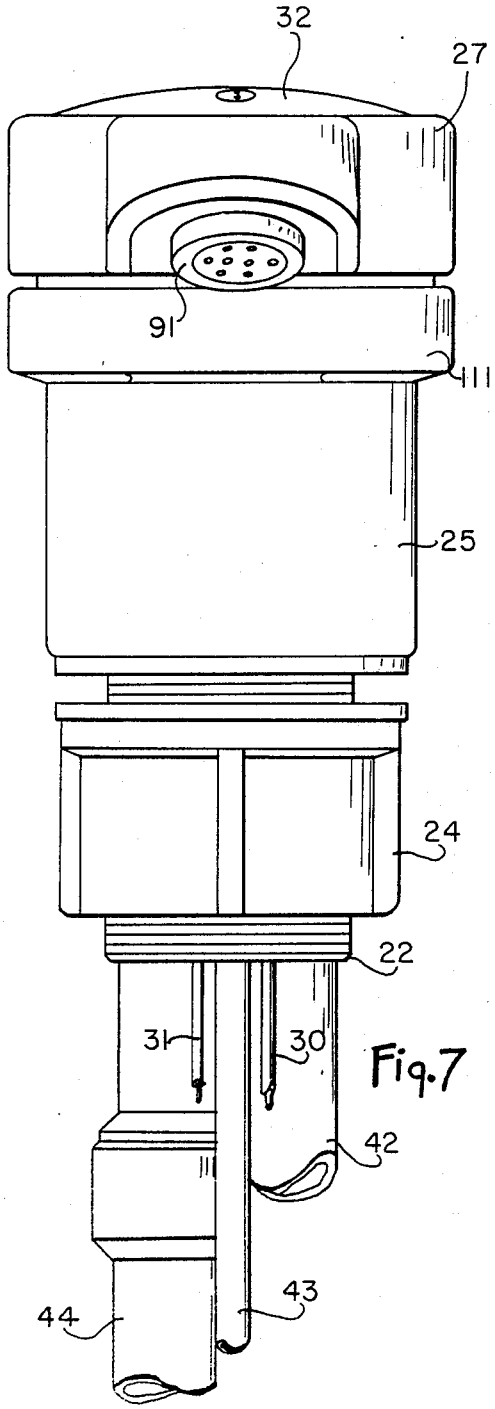
FIG. 7 is a front view of the dispenser.
Figure 4:
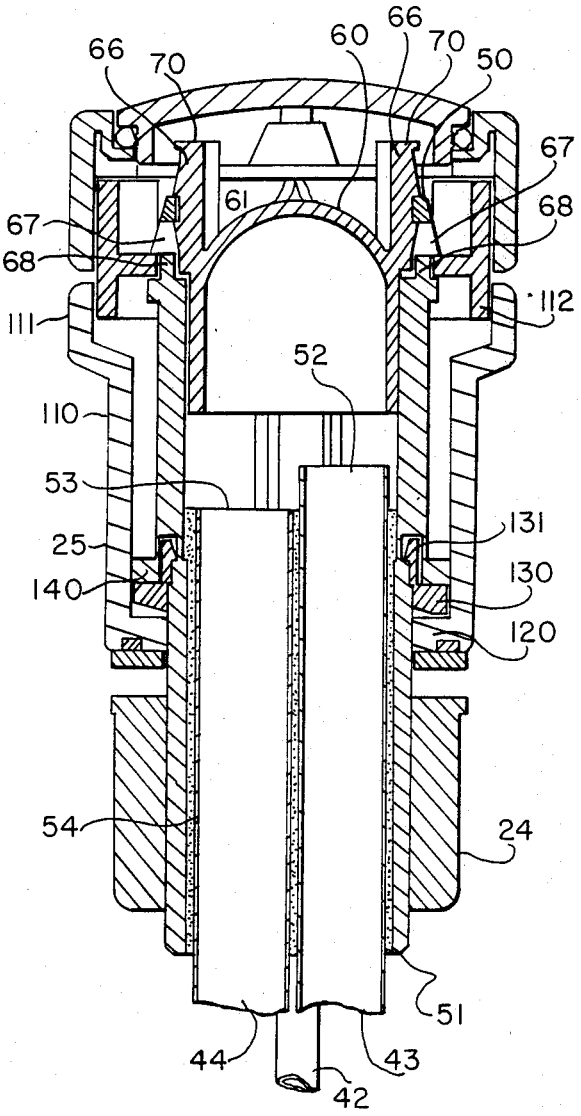
FIG. 4 is a partial longitudinal cross section of the dispenser, taken 90 degrees from the view of FIG. 3.

As illustrated in FIGS. 3 and 4, the central column 22 extends from the top end 50 thereof, to the bottom end 51. The dishwasher outlet tube 43 extends upwardly in the column a determined distance short of the top of the column, and has an upper end 52 above the upper end 53 of the waste outlet tube 44. A suitable, conventional sealant 54 fills the space in the lower part of the column, to provide a water tight seal for the tubes 42–44 as well as the fiber optic cables 30, 31.

An air gap cover 60 is fitted in the top of the column 22, the cover 60 having an open bottom chamber 61 positioned over the top end 52 of the dishwasher outlet tube, the chamber 61 having a curved bottom to deflect water from the top of the dishwasher outlet downwardly into the top 53 of the waste tube 44. An aperture 62 is provided at the rear of the column, above the level of the lowermost part of the air gap cover 60, to ensure ambient air pressure in the region of the upper ends of the tubes 43, 44, thereby to satisfy the requirements of an air gap in the waste water lines of the dishwasher. The dishwasher outlet line 43 extends upwardly into the chamber 61, so that its upper end 52 is above the bottom of the aperture 62, so that waste cannot flow backwardly from the outlet tube 44 to the dishwasher.

Figure 5:
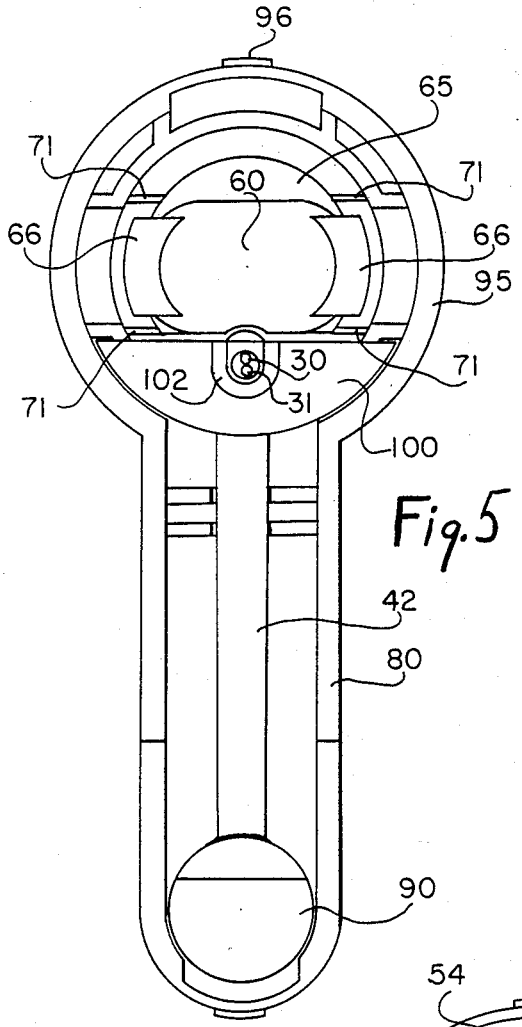
FIG. 5 is a top view of the dispenser, with the top cover removed.
Figure 8:
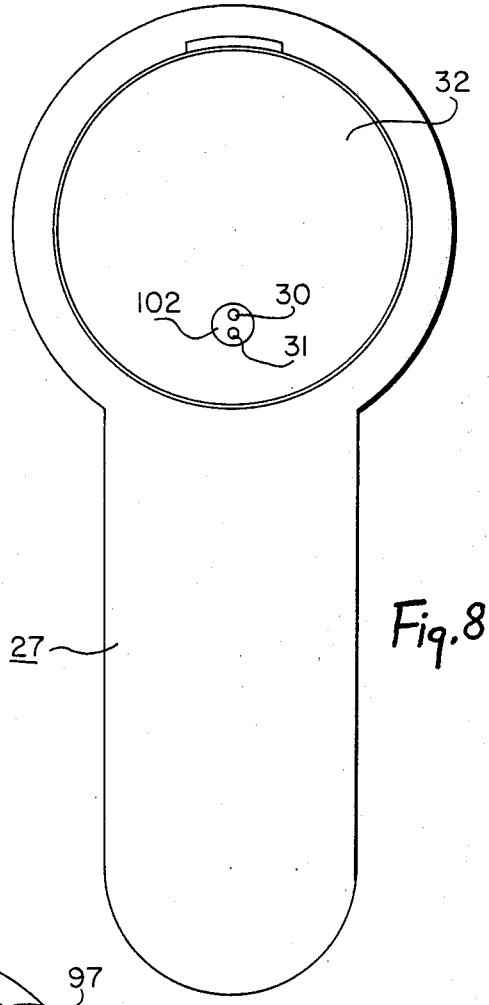
FIG. 8 is a top view of the dispenser.

The air gap cover 60 has a generally oval cross section, as illustrated in FIG. 5, and is installed by being urged downwardly into the top of the column 22. As illustrated in FIG. 4, the sides of the chamber 61 extend substantially to the inner walls of the column 22, to thereby direct the outlet of the tube 52 toward tee concave top of the air gap cover, to deflect laterally to the top of the drain tube 44. As illustrated in FIGS. 4 and 5 the width of the chamber 61, from front to back, is somewhat greater than the outer diameter of the tube 43, and a short wall 65 extends from the rear of the air gap cover, at the upper edge of the aperture 62, to inhibit splashing of liquids upwardly. The space in front of the air gap cover is generally open, for passage of the tube 42 and fiber optic cables. As illustrated more clearly in FIG. 4, a pair of upwardly extending projections 66 depending from the air gap cover have side projections 67 resiliently snapped into aperture 68 of the top of the column. The projections 66 extend upwardly to define a pair of spaced finger grips 70, to enable the air gap cover to be grasped and removed upwardly. In order to provide a resilient snap fit, slits 67 may be provided extending downwardly from the top of the column spaced from each side of the aperture 68, as seen in FIG. 5, to enable resilient yielding of the walls of the column.

The faucet extension 26 is comprised of a lower cover 80 having a rear aperture 81 aligned with and fixedly mounted on the outside of the top of the column 22 at its upper end. The cover 80 has a lateral extension 81, with a downwardly extending aperture 82 at its outer end, the lower cover 80 being upwardly open. A top cover 85 is snap fit over the lower cover by any conventional means, the side surfaces of the upper cover preferably defining the entire side surface of the faucet extension. A preferably round aperture 86 is provided in the upper cover aligned with the column 22, for receiving a removable top plate 87. The top plate 87 may be snap fit in the aperture 86, in a sealing manner, with an O-ring seal 88 being compressed between the lower surface of the outer edge of the top plate and an inwardly extending flange 89 surrounding the aperture 86 of the top cover.

As illustrated in FIG. 3, the liquid tube 42 extends laterally through the faucet extension to a fitting 90 at the end of the faucet extension, to thereby downwardly direct liquid from the tube through the aperture 82, by way of a conventional filter element 91, or the like.

Figure 6:
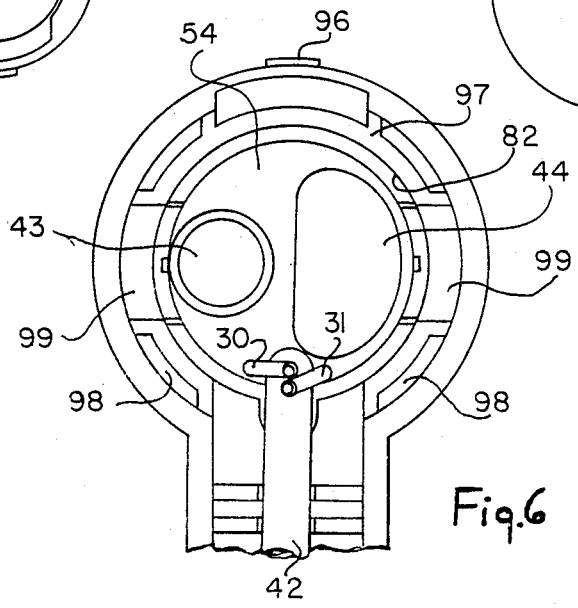
FIG. 6 is an enlarged view of a portion of the view of FIG. 5, with the air gap cover and fiber optic guide removed.

As illustrated in FIGS. 5 and 6, the rear of the lower cover 80 surrounding the rear aperture 82 thereof is flanged outwardly, and has a generally annular upwardly projecting portion 95, which may have an external rearward lug 96 for snap-fitting of the upper cover 85 thereon. A similar lug may be provided on the front end of the lower cover, as illustrated. The flange 97 from which the annular portion 95 extends may be provided with front downwardly extending recesses 98, and central downwardly extending recesses 99, the latter recesses permitting resilient lateral movement of the portions of the top of the column 22 adjacent to the snap apertures 68 therein. The annular portion 95 is open at the front thereof, for passage of the tube 42.

As illustrated in FIGS. 3 and 5, a segment-shaped fiber optic guide 100 is fitted to abut the top of the column 22, and having downwardly extending projections (not illustrated) extending into the recesses 98 to enable the guide to be snap-fit thereto. The arcuate front surface of the guide 100 abuts the inner surface of the annular portion 95 of the lower cover, and the straight rear edge 101 is forwardly of the projections 66 of the air gap cover.

The fiber optic guide 100 has an upwardly extending projection 102, that extends through an aperture 103 in the top plate 87, the top of the projection 102 being flush with the top of the plate 87. An O-ring seal 104 is provided between the bottom of the top plate 87 ad a shoulder on the fiber optic guide, to prevent liquids from being forced through the top of the assembly. The fiber optic cables 30, 31 extend upwardly through a pair of holes in the guide 100, with their upper ends exposed and flush with the top of the top plate 87.

As illustrated in FIGS. 3 and 4, the sleeve 25 surrounding the upper portion of the column has a generally cylindrical central portion 110, flanged outwardly at its upper end to provide an annular upper portion 111 closely surrounding an annular lower extension 112 of the lower cover 80, to thereby provide a smooth exterior appearance while permitting rotation of the sleeve 25. Apertures 115 may be provided extending downwardly through the flange between the central and upper portions 110, 111 of the sleeve.

The sleeve 25 further has an inwardly extending flange 120 at its lower end, closely abutting the lower portion of the column, so that a sealing gasket 121 may abut the lower surface of the flange 120. The upper surface of the flange 120 has one or more ramp surfaces 125 extending therearound, i.e. upwardly extending elongated saw teeth, axially abutting the downwardly extending ramps of a ramp ring 130. The ramp ring 130 has upwardly extending projections 131 adapted to be snapped or otherwise fitted into suitable recesses in the column, to inhibit relative rotation between the ramp ring 130 and the column. The column 22 may have a central outwardly extending flange 140 abutting the inner surface of the sleeve 25, to insure proper spacing thereof, with suitable recesses extending through the flange 140, as illustrated in FIG. 4, for receiving the upwardly extending holding projections 131 of the ramp ring.

The ramp ring 131 and ramp surfaces of the flange 120 of the sleeve cooperate to simplify the installation of the dispenser of the invention. Thus, during insulation, the device is downwardly fit through a hole in the sink, and the nut 24 is threaded on the threaded end of the column, under the sink, by hand. The installer may then orient the faucet in the desired direction, and manually rotate the sleeve 25 to force the sleeve axially toward the sink, thereby to firmly old the dispenser in the desired position. The cooperation between the ramp ring 131 and the ramp surfaces of the flange 120 exerts an axial force between the flange 140 of the column, and the sink surface, to firmly clamp the dispenser in position. Thus, the use of wrenches or the like, beneath the sink, to tighten the dispenser in position, is not necessary.

Figure 9:
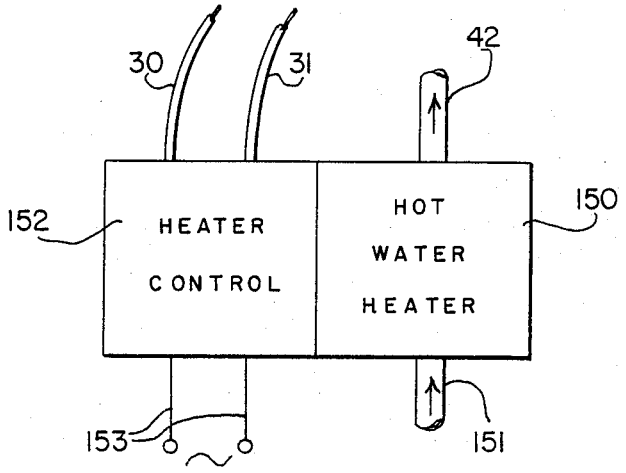
FIG. 9 is a simplified block diagram of the interconnections of the dispenser.

In one example of use of the invention, for using the dispenser for the supply of hot water, as illustrated in FIG. 9, the tube 42 is connected to a hot water heater 150 adapted to be supplied from a water supply line 151. The heater 150 is controlled by a heater control system 152, connected to a supply source 153. The fiber optic cables 30, 31 are connected to the heater control system 152, for controlling suitable conventional valves in the hot water heater system 150, to selectively permit the flow of hot water to the tube 42. The hot water heater 150 may be of any conventional type, for example, an in-line electrically operated heater adapted to maintain the temperature of water dispensed therefrom at a determined degree.

Figure 10:
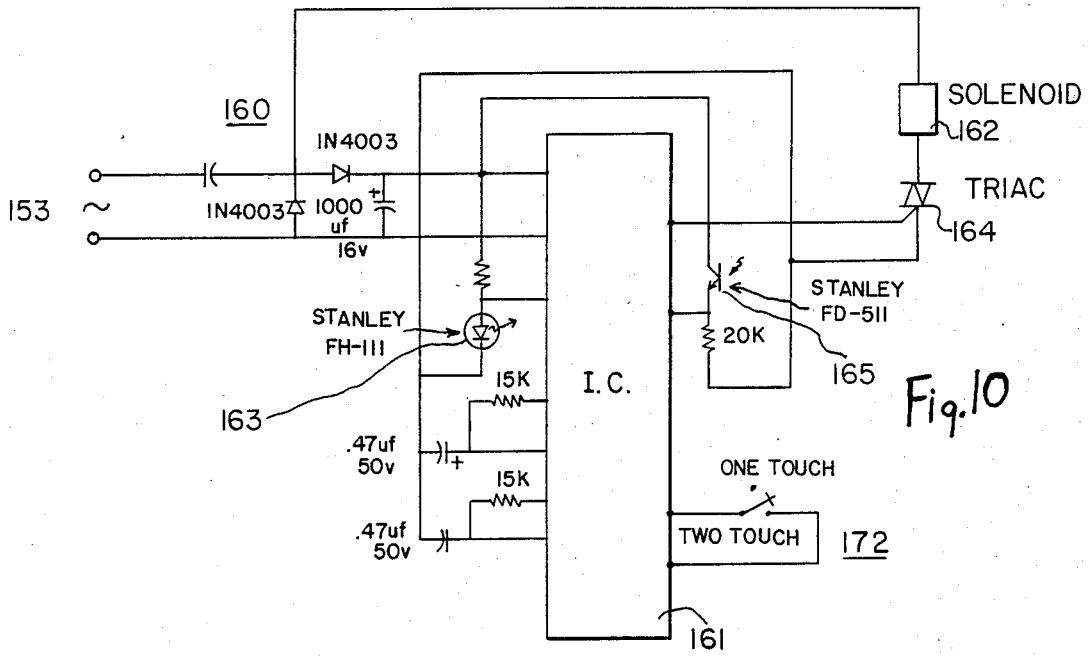
FIG. 10 is a simplified circuit for the control of the dispenser.

One embodiment of a heater control circuit is illustrated in FIG. 10, wherein the electrical supply 153 is applied to a rectifier circuit 160 for the supply of an integrated circuit 161 (to be described in detail later), and a solenoid 162, the solenoid being, for example, the coil of a solenoid valve in the ho water heater. The integrated circuit 161 applies an operating voltage to drive an LED 163, and applies a gate voltage to the triac 164 for energizing the solenoid 162. A photodetector 165 has its output coupled to the integrated circuit 161. The LED 163 and photodetector 165 are fitted to the fiber optic cables 30, 31, respectively, for example by way of the couplers 40, 41. As a consequence, light from the LED 163 is passed upwardly through the fiber optic cable 30, and reflected therefrom by a finger or the like at the top of the fiber optic cables 30, 31, to the photodetector 165.

The integrated circuit 161 is further connected to a timing circuit 170 for the internal oscillation frequency thereof, a timing circuit 171 for amplifier compensation therein, and a switching circuit 172 adapting the dispenser control to be selectively responsive to one, or two touches of the finger, to operate the solenoid valve.

Figure 11:
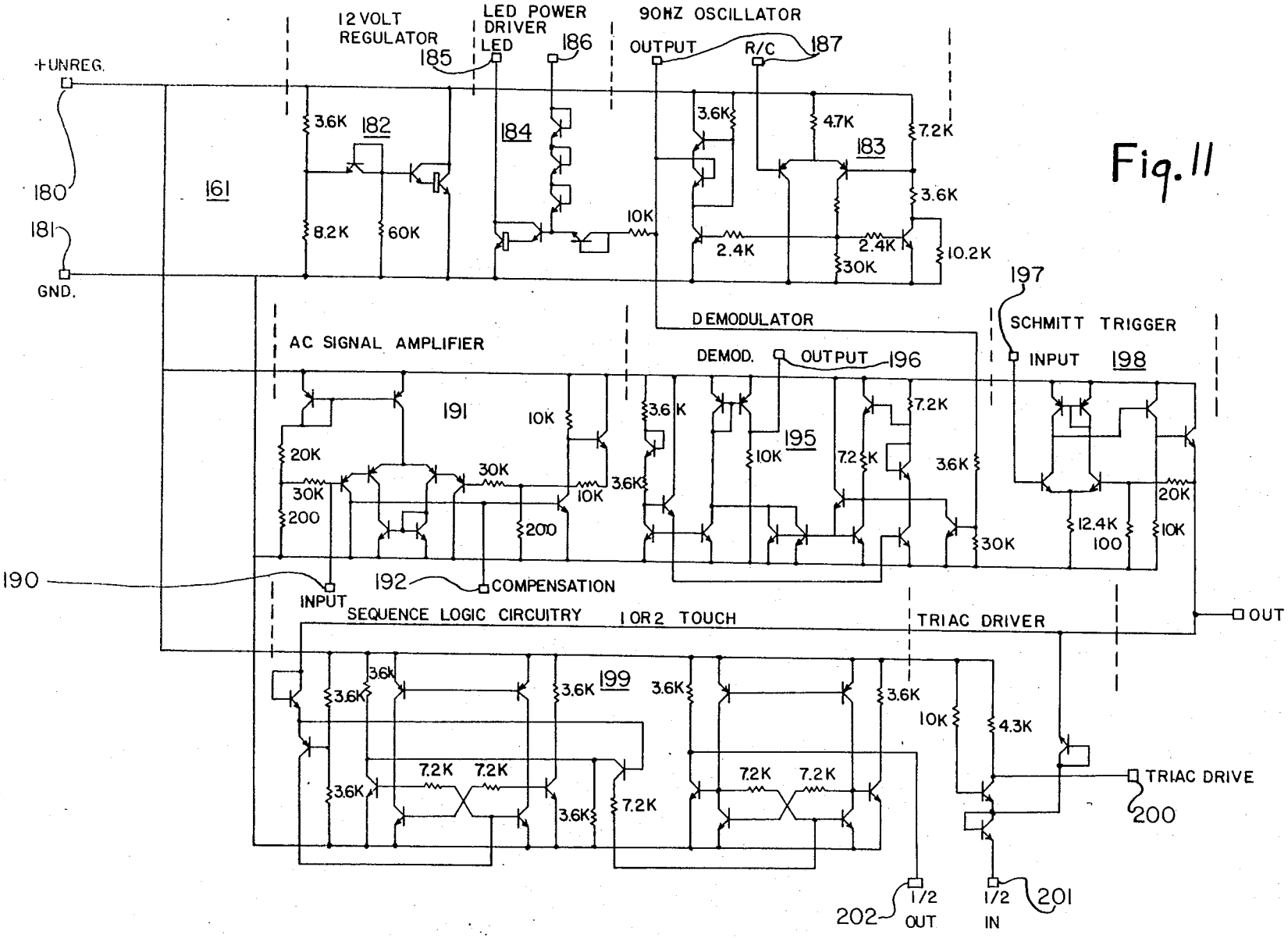
FIG. 11 is a circuit diagram of the integrated circuit employed in FIG. 10.

The integrated circuit 161, as illustrated in FIG. 11, has supply terminals 180, 181 for receiving the unregulated supply voltage, and a voltage regulator 182, for example a shunt regulator, for regulating the operating voltage of the circuit to, for example, 12 volts.

An RC oscillator 183, operating at, for example, 40 Hz, is connected to modulate an LED driver 184, the driver 184 having a pair of terminals 185, 186 adapted to be connected to the LED 163. The terminals 187 of the oscillator are adapted to be connected to the timing circuit 170, to control the oscillator frequency.

The photodetector 165 is adapted to be connected to the input terminal 190 of an AC signal amplifier 191, the signal amplifier having a compensation terminal 192 for connection to the compensation timing circuit 171. The output of the amplifier 191, and the oscillator voltage, are applied to a demodulator 195 for synchronously demodulating the output of the amplifier, thereby to provide an output voltage at terminal 196 responsive to the light that has been reflected from the fiber optic cable 30 to the fiber optic cable 31. The output of the demodulator, at terminal 196, is connected externally of the integrated circuit to the input terminal 197 of a Schmitt trigger 198, to provide an output having either a high or a low level, to a sequence logic circuit 199. The sequence logic circuitry 199 is responsive to the application of either one or two pulses from the Schmitt trigger thereto, to apply a trigger voltage to the terminal 200, depending upon the position of the switch 172, the switch 172 of FIG. 10 being adapted to be connected between the terminals 201, 202. As a consequence, in one position of the switch 172 the triac 164 will be triggered each time a finger is placed adjacent the tops of the two fiber optic cables 30, 31 whereas in the second position of the switch, the circuit will be responsive to trigger the triac only on the second touching of the finger to the tops of the fiber optic cables.

It is of course apparent that the sequence logic circuitry may be modified in conventional manner to render the circuit responsive to any desired sequence of touching of the fiber optic cables, both as to number of touches and timing therebetween.

Figures 12, 13:
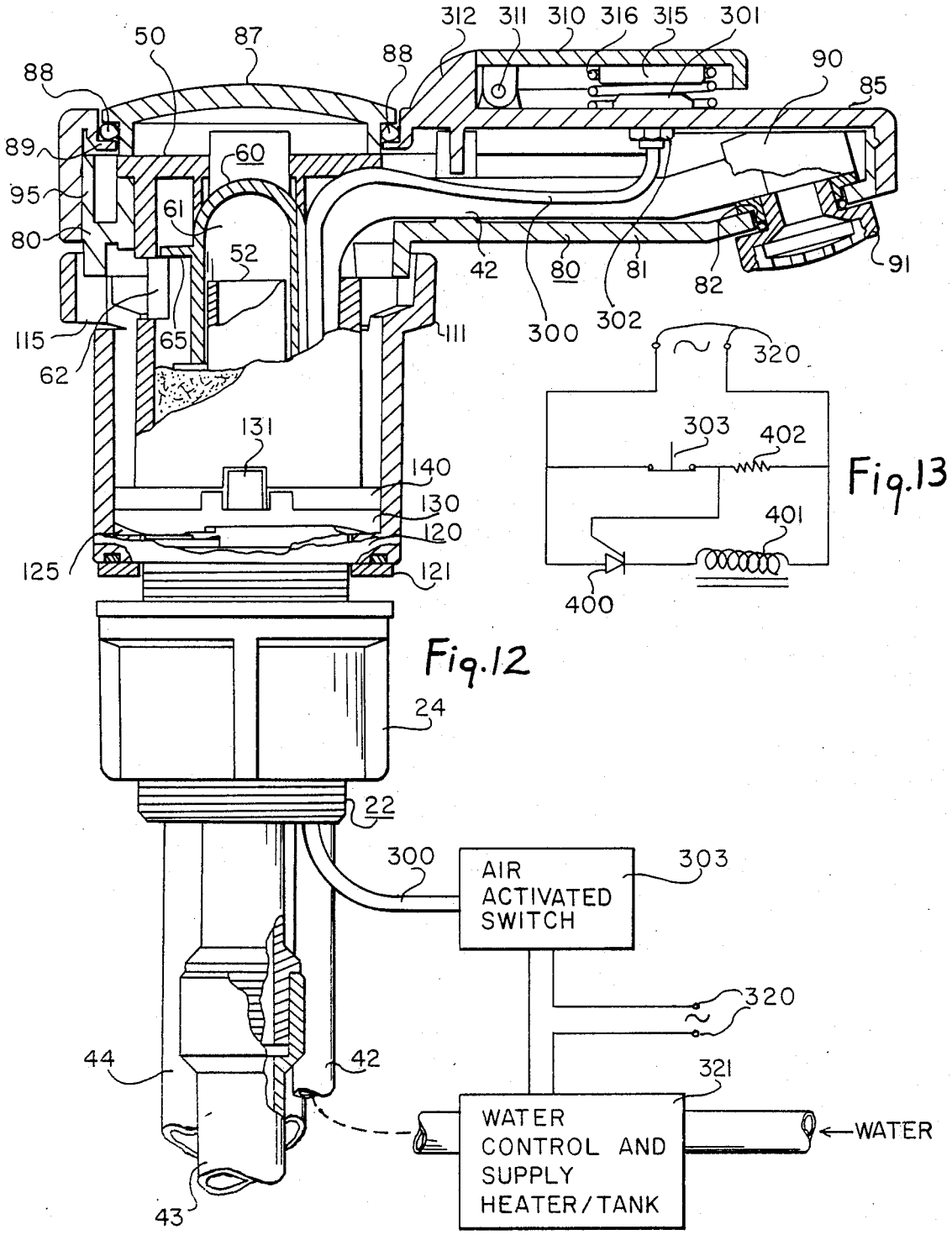
FIG. 12 is a partially cross sectional view of a modified form of the dispenser of the invention.
FIG. 13 is a circuit diagram of a modification of the arrangement of FIG. 1.

In the embodiment of the invention illustrated in FIG. 12, the optical cables extending through the column 22 are omitted, and, instead, a pneumatic tube 300 extends through the column, with the upper end thereof being connected within the faucet extension to a pneumatic actuator 301. In the illustrated embodiment of the invention, the actuator 301 is mounted with its actuating end above the top cover 85, the actuator extending through the top cover 85 and being held by the nut 302. It is of course apparent that any other conventional means for mounting the actuator 301 may be provided, and that the specific location for the actuator in the assembly of the invention may be varied as desired. The lower end of the tube 300, extending from the bottom of the column 22, is connected to an air activated switch 303.

The combination of a pneumatic actuator, air activated switch and interconnecting pneumatic tube, is known, such elements being manufactured by Herga Electric Limited, Suffolk, England. In arrangements of this type, the pneumatic actuator 301 may comprise a sealed bellows having an outlet connected to the tube 300. The switch 303 may thus be a conventional pressure actuated switch. This system enables control of the switch 303 from the faucet without the provision of electrical connections.

Further referring to FIG. 12, a lever 310 may be pivotally mounted to the top cover 85, extending forwardly from the pivot axis 311 over the actuator 301, having downwardly extending lips about its sides and front, to protect the actuator and provide a more pleasing appearance to the structure. The end of the cover 85 toward the column may be provided with an upwardly extending boss 312 comprising a smooth extension of the rear of the operating lever. The underside of the lever 310 is provided with a projection 315 vertically aligned with the actuator, and adapted to engage and depress the actuator upon manual depression of the lever. The projection 315 may for example be of a plastic material, or a resilient material. The lever 310 is upwardly biased by a helical spring 316 surrounding the actuator and extending from the cover 85 to the underside of the lever 310, upward movement of this lever being limited by conventional means, for example by abutment of the rear of the lever with the boss 312 as illustrated. It is thus apparent that, upon manual depression of the lever 310, the switch 303 may be actuated as desire, without the necessity of extending potentially dangerous electrical connectors directly into the faucet assembly.

As further illustrated in FIG. 12, the air activated switch may be connected to apply current from source terminals 320 to a water control device 321. The water control device may include a valve, such as a solenoid controlled valve, coupled between the source of water and the supply tube 42. The control device 321 may, if desired, include a water heater and/or water tank for supplying water or other liquids to the faucet.

It is of course apparent that, instead of pneumatic control system, other fluid control systems may alternatively be employed in the arrangement of FIG. 12.

In a further embodiment of the invention, as illustrated in FIG. 3, the air activated switch 303 is connected to trigger an SCR 400, the SCR being connected in series with the solenoid 401 of a solenoid valve provided, for example, as the water control device 321 of FIG. 12. In the circuit of FIG. 13, the switch 303 is connected in series, across the a.c. line, with a dropping resistor 402, the control voltage for the gate of the SCR being taken across the resistor 402.

While the invention has been disclosed and described with reference to a single embodiment, it is apparent that variations and modifications may be made therein, and it is therefore intended in the following claims to cover each such variation and modification as falls within the true spirit and scope of the invention.

We claim:

1. A dispensing appliance, comprising a mounting arrangement comprising a column having a hole extending longitudinally therethrough, and means for mounting said column to extend substantially vertically non-electric coupling means extending through said column for controlling said valve, said supply tube, inlet tube, outlet tube and coupling means extending sealingly through said hole.

2. A dispensing appliance, comprising:

a column having a lower end with external threads for enabling mounting said column to extend substantially vertically through a surface, and an upper end, a dispensing head affixed to said upper end and extending laterally therefrom, said dispensing head having a downwardly directed dispensing orifice on the end thereof away from said column, a supply tube extending from said orifice laterally through said dispensing head and thence downwardly through said lower end of said column, without any flow control device therein, a waste water inlet tube and a waste water outlet tube each extending into said column from said lower end while terminating short of the upper end thereof, an air gap being defined in said column communicating with the upper ends of said inlet and outlet tubes, a pneumatic tube extending into said column from the lower end thereof, said pneumatic tube having an upper end, and a pneumatic actuating device mounted on said dispensing head and coupled to the upper end of said pneumatic tube for varying pneumatic pressure therein, a valve mounted externally of said column and connected to said supply tube for supplying liquid to said supply tube, and a pneumatically operated control device connected to said pneumatic tube for controlling said valve, said column having sealed partition means therein through which said inlet, outlet and supply tube and pneumatic tube extend.

3. A dispensing appliance comprising a support adapted to be mounted to a surface, said support defining a plane adapted to abut said surface, an air gap in said support on one side of said plane, and a pair of tubes extending in said support to said air gap from the other side of said plane, said tubes being available at the other side of said plane for connection to a waste water system, and further comprising a fluid filled tube extending in said support from said other side of said plane, a fluid control system at said other side of said plane and connected at said other side of said plane to said fluid filled tube, a manually operable fluid actuator mounted to said support on said one side of said plane and connected to said fluid filled tube to permit adjustment of the pressure therein, said dispenser further comprising a liquid dispensing tube extending through said support, and an outlet coupled to said liquid dispensing tube on said one side of said plane, said dispensing tube being connected a said other side of said plane to a liquid supply system via said fluid control system, whereby said fluid control system effects the sole control of fluid flow in said dispensing tube.

4. The dispenser of claim 3 wherein said actuator is a pneumatic actuator.

5. A dispensing appliance, comprising:

a dispensing body comprising a column and means for mounting said column to extend substantially vertically through a surface whereby said column has upper and lower ends, and a dispensing head depending from said upper end, said dispensing head having a dispensing orifice, said means for mounting comprising mounting nuts and external threads on said lower end of said column for receiving said mounting nuts, a supply tube extending from said orifice, through said dispensing head and through said lower end of said column, continuously, without flow control means, and having an inlet externally of said column, a waste water inlet tube and a waste water outlet tube each extending into said column from said lower end, an air gap within said column communicating with said inlet and outlet, a fluid filled tube extending through said column, a fluid actuated device at said lower end of said column and affixed to said fluid filled tube, and a manually operable fluid actuating device on said dispensing body and connected to said fluid filled tube for manually varying the pressure of fluid in said fluid filled tube.

6. The dispensing appliance of claim 5 wherein said dispensing head extends laterally of said column and said orifice extends downwardly from said dispensing head.

7. The dispensing appliance of claim 5 wherein said manually operable actuating device comprises a pneumatic actuator mounted to said dispensing head, an operating lever pivotally mounted to said dispensing head and positioned to engage said pneumatic actuator, and a spring for biasing said lever away from said pneumatic actuator.

* * * * *

UNITED STATES PATENT AND TRADEMARK OFFICE

CERTIFICATE OF CORRECTION

PATENT NO. : 4,911,335

DATED : March 27, 1990

INVENTOR(S) : Stofle et al.

It is certified that error appears in the above-identified patent and that said Letters Patent is hereby corrected as shown below:

Column 2, line 37, delete "FIG. 1" and insert --FIG. 12--.

Column 3, line 44, delete "tee" and insert --the--.

Column 3, line 46, after "5" insert --,--.

Column 4, line 46, delete "ad" and insert --and--.

Column 5, line 20, delete "old" and insert --hold--.

Column 7, line 19, delete "desire" and insert --desired--.

Column 7, line 53, Claim 1 should read as follows:

1. A dispensing appliance, comprising a mounting arrangement comprising a column having a hole extending longitudinally therethrough, and means for mounting said column to extend substantially vertically through a surface whereby said column has upper and lower ends, said mounting means comprising mounting nuts and external threads on said lower end for receiving said mounting nuts, a dispensing head depending from said upper end of said column, said dispensing head having a dispensing orifice, a supply tube extending from said orifice through said dispensing head and through said hole to the lower end of said column and having an inlet end external of said column,

UNITED STATES PATENT AND TRADEMARK OFFICE

CERTIFICATE OF CORRECTION

PATENT NO. : 4,911,335

DATED : March 27, 1990

INVENTOR(S) : Stofle et al.

It is certified that error appears in the above-identified patent and that said Letters Patent is hereby corrected as shown below:

a waste water inlet tube and a waste water outlet tube each extending into said hole from said lower end, an air gap within said column communicating with said inlet and outlet tubes, said air gap including an air gap cover for diverting liquids from said inlet tube to said outlet tube, and means mounting aid air gap cover to said upper end of said column, a valve connected to said inlet end of said supply tube and adapted to be connected to a fluid supply, whereby said valve effects the only flow control of fluid through said supply tube, and a valve control mounted external of said column and connected to control said valve, and manual actuating means on said dispensing head and connected to said valve control via non-electric coupling means extending through said column for controlling said valve, said supply tube, inlet tube, outlet tube and coupling means extending sealingly through said hole.

Signed and Sealed this

Fourth Day of June, 1991

*Attest:*

HARRY F. MANBECK, JR.

*Attesting Officer*

*Commissioner of Patents and Trademarks*